US006149847A

United States Patent [19]

Geier et al.

[11] Patent Number: 6,149,847

[45] Date of Patent: Nov. 21, 2000

[54] METHOD OF AND APPARATUS FOR THE PRODUCTION OF POLYESTER YARN

[75] Inventors: Rudolf Geier; Ingo Effländer, both of Essen; Jürgen Hartig, Gladbeck, all of Germany

[73] Assignee: Krupp Uhde GmbH, Dortmund, Germany

[21] Appl. No.: 09/285,435

[22] Filed: Apr. 2, 1999

[30] Foreign Application Priority Data

Apr. 17, 1998 [DE] Germany ..... 198 16 979

[51] Int. Cl.[7] ..... D01D 5/084; D01D 5/088; D01D 5/16; D01F 6/62

[52] U.S. Cl. ..... 264/103; 264/210.7; 264/210.8; 264/211.12; 264/211.15; 264/211.17; 425/66; 425/377; 425/378.2; 425/379.1; 425/382.2; 425/464

[58] Field of Search ..... 264/103, 210.7, 264/210.8, 211.12, 211.15, 211.17, 555; 425/66, 72.2, 377, 378.2, 379.1, 382.2, 464

[56] References Cited

U.S. PATENT DOCUMENTS 5,965,073 10/1999 Geier et al. ..... 264/103

FOREIGN PATENT DOCUMENTS 195 29 135 2/1997 Germany .
90/04667 5/1990 WIPO .
96/20299 7/1996 WIPO .

*Primary Examiner*—Leo B. Tentoni
*Attorney, Agent, or Firm*—Herbert Dubno

[57] ABSTRACT

Polyester yarn is made by melt spinning the polyester filaments which are then cooled at least to solidification and heated by counterflow with prestretching to a crystallinity in excess of 24%. The prestretched filaments are gathered and stretched to after-stretching at a temperature of 80° C. to 250° C. to a final titer of 1.0 dtex to 7.5 dtex with a stretching ratio of 1:1.5 to 1:1.15. The yarn is then wound up at a rate of 5000 to 8000 m/min.

7 Claims, 1 Drawing Sheet

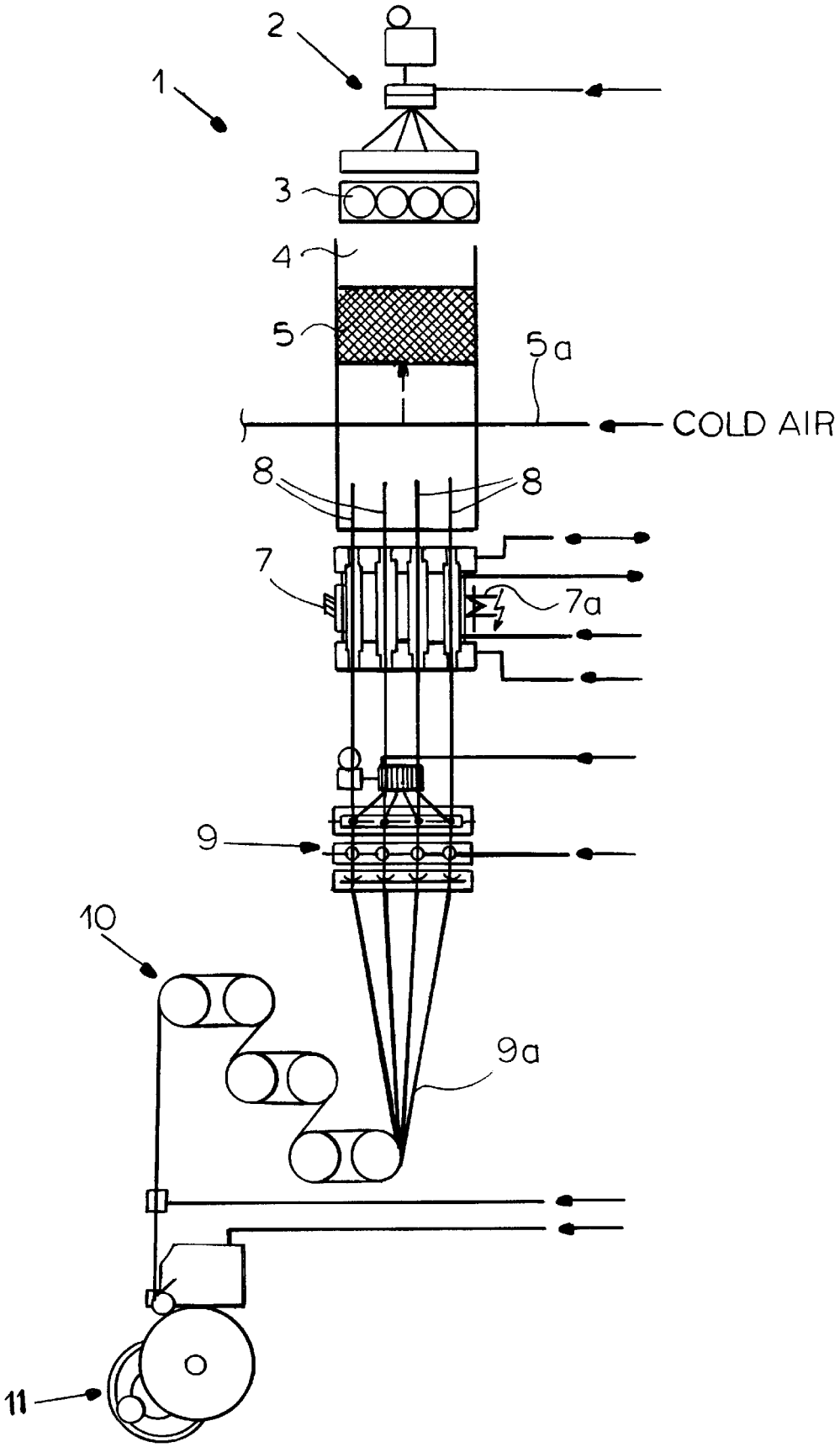
2
1
3
4
5
5a
COLD AIR
8
8
7
7a
9
10
9a
11

METHOD OF AND APPARATUS FOR THE PRODUCTION OF POLYESTER YARN

FIELD OF THE INVENTION

Our present invention relates to a method of producing polyester yarn and, especially, a polyester yarn suitable for industrial purposes. The invention also relates to an apparatus for producing such yarn.

BACKGROUND OF THE INVENTION

In our copending application Ser. No. 09/011,013 filed Feb. 2, 1998 (U.S. Pat. No. 5,965,073 of Oct. 12, 1999) and the corresponding German application DE 195 29 135 A1, a process for making dimensionally stable polyester yarn for highly dimensionally stable cords, e.g. for the reinforcement of conveyor belts, seat belts, V belts, hoses and for use as tire cord, has been described.

In this process, the polyester yarn is produced from melt-spun polyester filaments, i.e. polyester filaments which are extruded from a spinneret and gathered or bundled to form the yarn.

In that system, downstream of the spinneret or spinning nozzle, a cooling zone is provided which cools the extruded-melt polyester filaments to at least the solidification temperature, whereupon the polyester filaments can be heated in a counterflow heating zone to a temperature above the glass transition temperature. The polyester filaments can then be subjected to a prestretching in this counterflow heating zone and following the prestretching can be subjected as a yarn to a final stretching operation of an end titer of 0.1 dtex to 7.5 dtex at a temperature of 80° C. to 250° C. with a stretching ratio of 1:1.5 to 1:1.15. The polyester yarn is then wound up with a winding sped of 5000 m/min to 8000 m/min. The end titer or final titer is, of course, the titer following this after-stretching operation.

The process described in this application gives rise to a polyester yarn which over the entire titer range of say 1 dtex to 1100 dtex or greater is highly stable and the method is easy to carry out and convenient.

It has long been recognized that a problem with polyester yarns and even the filaments which go to make up such yarns is the dimensional stability. The dimensional stability DS is generally considered to have a component which can be referred to as the standard elongation, generally given in percent and a component which is temperature based, for example hot air shrinkage (also given in percentage) so that the dimensional stability can be defined as $$DS = EASL\ (45N) + HAS\ (180/190°\ C).$$

The expression "EASL" refers to "Elongation at specified load" and "HAS" means "Hot air shrinkage" and these have values for a yarn with a titer of 1100 dtex typically as shown in the following table:

| | EALS | HAS | DS |
|---|---|---|---|
| LS (Low Shrinkage | ~18 | ≦3 | ~21 |
| HM (High Modulus) | >3.7 | ≦9 | ~13 |
| HMLS (High Modulus Low Shrinkage | >3.7 | ≦3 | ~7 |

The shrinkage and elongation can only be set at desired values when the dimensional stability DS can be guaranteed. A precondition for such dimensional stability is the crystallinity of the polyester filaments. The higher the crystallinity the more stable are the polyester filaments and hence the yarn made from those polyester filaments. The greater the crystallinity, therefore, the more resistant the yarn is to high temperatures and the smaller is the shrinkage.

In the production of polymer yarns it is known to provide polyethylene terephthalate filaments, a typical polyester, with a crystallinity of 5% to 14% (see PCT/WO 96/20299) or with a crystallinity of 16% to 24% (see PCT/WO 90/04667). However, the polyester yarns produced with such filaments are not fully satisfactory.

OBJECTS OP THE INVENTION

It is the principal object of the present invention to provide a method of making polyester yarns with high dimensional stability and especially low shrinkage whereby drawbacks of earlier yarns can be obviated.

It is also an object of the invention to provide an improved apparatus for making such yarns.

SUMMARY OF THE INVENTION

These objects and others which will become apparent hereinafter are attained in accordance with the invention by heating the polyester filaments in the counterflow heating zone to a temperature of 100° C. to 199° C., preferably 120° C. to 170° C., to prestretching the polyester filaments to produce a crystallinity in excess of 24%. In accordance with the invention, in the prestretching stage the polyester filaments can be obtained with a crystallinity of 25% to 29% or can be prestretched to crystallinities of 30% to 50%. As a consequence the polyester filaments which are obtained are especially stable and not only have the standard elongation required for such high dimensional stability but also extremely low shrinkage values. The DS values given in the table are easily achieved and hence the dimensional stability is ensured.

The polyester yarns which are produced have been found to be especially stable for reinforcing fabrics to be incorporated in rubber or plastic structures. To produce crystallinities of 30% to 50%, the polyester filaments can be heated in a blast or air to temperatures of 200° C. to 350° C., preferably 220° C. to 270° C. The stretching is carried out not only with the filaments in an unbundled or ungathered state in the counterflow heating zone but preferably with treatment utilizing air quantities of 5 $m^3$/h to 50 $m^3$/h and most preferably 26 $m^3$/h to 40 $m^3$/h.

The method of the invention can thus comprise the steps of:

(a) melt spinning a multiplicity of molten polyester filaments;

(b) cooling the molten polyester filaments at least sufficiently to solidify them into solid polyester filaments;

(c) heating and prestretching the solid polyester filaments by passing the solid polyester filaments separated from one another through a counterflow heating zone in counterflow to a gaseous medium while heating the solid polyester filaments to a temperature of 100° C. to 199° C. and above the glass transition temperature thereof to generate a crystallinity of >24% in prestretched polyester filaments;

(d) thereafter gathering the prestretched polyester filaments and stretching the gathered polyester filaments as a yarn to a final titer following the stretching of 1.0 dtex to 7.5 dtex at a temperature of 80° C. to 250° C. and at a stretching ratio of 1:1.5 to 1:1.15; and (e) thereafter winding up the yarn at a rate of 5000 m/min to 8000 m/min.

An apparatus for making the polyester yarn can comprise:

a spinneret for melt spinning a multiplicity of molten polyester filaments;

means downstream from the spinneret for cooling the molten polyester filaments at least sufficiently to solidify them into solid polyester filaments;

means downstream from this cooling stage for heating and prestretching the solid polyester filaments in counterflow with a hot gas which heats the solid polyester filaments to a temperature of 100° C. and 199° C. and above the glass transition temperature to produce a crystallinity in excess of 24% in the prestretched polyester filament;

means for gathering the prestretched polyester filaments into a yarn and stretching that yarn to a final titer following the stretching of 1.0 dtex to 7.5 dtex at a temperature of 70° C. to 250° C. and a stretching ratio of 1:1.5 to 1:3.5; and means downstream of the stretching means for winding up the yarn at a rate of 5000 m/min to 8000 m/min.

BRIEF DESCRIPTION OF THE DRAWING

The above and other objects, features, and advantages will become more readily apparent from the following description, reference being made to the sole FIG. of which is a diagrammatic elevational view of an apparatus for making a polyester yarn according to the invention.

SPECIFIC DESCRIPTION

The apparatus shown in the drawing for producing a fully oriented polyester yarn suitable for use in tire cord, as reinforcement yarn for rubber and plastic articles, in fabric or industrial purposes and the like comprises a spinning unit 1 with an extruder 2 and a spinning beam formed with spinning nozzles or orifices, i.e. the spinneret 3. The extruder 2 supplies the spinneret with the polyester melt and from the spinneret, melt-spun strands of polyester emerge which pass through an after-heating zone 4 in which the temperature is homogenized. The individual filaments, separate from one another, then pass through a cooling zone where they are subjected to an air blast, the air blast being supplied via a line 5*a*. The unbundled filaments 8 then pass through a counterflow heating zone 7 in which the filaments are treated with upwardly flowing streams of heated air and wherein, additionally, electric heating is supplied at 7*a*, so that, in this heating and prestretching zone the polyester filaments are heated to a temperature above the glass transition temperature and are stretched by the frictional retardation of the up-flowing air to generate a crystallinity greater than 24% in the filaments.

The filaments are than fed at 9 to a treatment zone in which they may be coated or otherwise modified, e.g. colored, whereupon the filaments are collected or bundled at 9*a* before being stretched as a yarn in the gallet 10 which can be heated to the stretching temperature. The gallets 10 are driven at progressively higher speeds to effect the after stretching of the polyester yarn. Downstream of the gallets 10 is a wind up unit 11 for the stretched polyester yarn and operated at a wind-up speed of 5000 to 8000 m/min. In the heating and prestretching zone, the polyester filaments are heated to a temperature of 100° C. to 199° C. and can be prestretched to a crystallinity of 25 to 29% or, if desired, to a crystallinity which is even higher, namely 30% to 50%. The amount of air used in the zone 10 to prestretch filaments can be 5 $m^3$/h to 50 $m^3$/h and preferably 26 $m^3$/h to 40 $m^3$/h.

The yarn has the dimensional stability described and of extremely low thermal shrinkage.

We claim:

1. A method of making a polyester yarn, comprising the steps of:

(a) melt-spinning a multiplicity of molten polyester filaments;

(b) cooling said molten polyester filaments at least sufficiently to solidify them into solid polyester filaments;

(c) heating and prestretching said solid polyester filaments by passing said solid polyester filaments separated from one another through a counterflow heating zone in counterflow to a gaseous medium while heating said solid polyester filaments to a temperature of 100° C. to 199° C. and above the glass transition temperature thereof to generate a crystallinity of >24% in prestretched polyester filaments;

(d) thereafter gathering the prestretched polyester filaments and stretching the gathered polyester filaments as a yarn to a final titer following the stretching of 1.0 dtex to 7.5 dtex at a temperature of 80° C. to 250° C. and at a stretching ratio of 1:1.5 to 1:1.15; and (e) thereafter winding up said yarn at a rate of 5000 m/min to 8000 m/min.

2. The method defined in claim 1 wherein said solid polyester filaments are prestretched in step (c) to a crystallinity of 25% to 29%.

3. The method defined in claim 1 wherein said solid polyester filaments are prestretched in step (c) to a crystallinity of 30% to 50%.

4. The method defined in claim 1 wherein said solid polyester filaments are subjected in step (c) to said gaseous medium in counterflow in an amount of5 $m^3$/h to 50 $m^3$/h.

5. The method defined in claim 4 wherein said solid polyester filaments are subjected in step (c) to said gaseous medium in counterflow in an amount of 26 $m^3$/h to 40 $m^3$/h.

6. The method defined in claim 5 wherein said temperature in step (c) is 120° C. to 170° C. and above said glass transition temperature.

7. An apparatus for making a polyester yarn comprising:

a spinneret for melt spinning a multiplicity of molten polyester filaments;

a cooling station downstream of said spinneret for cooling said molten polyester filaments at least sufficiently to solidify them into solid polyester filaments;

means downstream of said cooling station for heating and prestretching said solid polyester filaments by passing said solid polyester filaments separated from one another through a counter-flow heating zone in a counterflow to a gaseous medium in an amount of 5 $m^3$/h to 50 $m^3$/h while heating said solid polyester filaments to a temperature of 100° C. to 199° C. and above the glass transition temperature thereof to generate a crystallinity greater than about 24% in prestretched polyester filaments;

means for gathering the prestretched polyester filaments into a yarn and stretching the yarn to a final titer of 1.0 dtex to 7.5 dtex at a temperature of 80° C. to 250° C. at a stretched ratio of 1:1.5 to 1:1.15; and means for winding up the stretched yarn at a rate of 5000 m/min to 8000 m/min.

a spinneret for melt spinning a multiplicity of molten polyester filaments;

a cooling station downstream of said spinneret for cooling said molten polyester filaments at least sufficiently to solidify them into solid polyester filaments;

means downstream of said cooling station for heating and prestretching said solid polyester filaments by passing said solid polyester filaments separated from one another through a counterflow heating zone in a counterflow to a gaseous medium in an amount of 5 $m^3/h$ to 50 $m^3/h$ while heating said solid polyester filaments to a temperature of 100° C. to 199° C. and above the blast transition temperature thereof to generate a crystallinity greater than about 24% in prestretched polyester filaments;

means for gathering the prestretched polyester filaments into a yarn and stretching the yarn to a final titer of 1.0 dtex to 7.5 dtex at a temperature of 80° C. to 250° C. at a stretched ratio of 1:1.5 to 1:1.15; and means for winding up the stretched yarn at a rate of 5000 m/min to 8000 m/min.

* * * * *